US012612706B2

(12) United States Patent
Arimoto et al.

(10) Patent No.: US 12,612,706 B2
(45) Date of Patent: Apr. 28, 2026

(54) ANODE FOR ALKALINE WATER ELECTROLYSIS

(71) Applicant: DE NORA PERMELEC LTD, Kanagawa (JP)

(72) Inventors: Osamu Arimoto, Kanagawa (JP); Akihiro Kato, Kanagawa (JP); Takaaki Nakai, Kanagawa (JP)

(73) Assignee: DE NORA PERMELEC LTD, Kanagawa (JP)

( * ) Notice: Subject to any disclaimer, the term of this patent is extended or adjusted under 35 U.S.C. 154(b) by 522 days.

(21) Appl. No.: 18/041,133

(22) PCT Filed: Apr. 8, 2021

(86) PCT No.: PCT/JP2021/014877
§ 371 (c)(1),
(2) Date: Feb. 9, 2023

(87) PCT Pub. No.: WO2022/044417
PCT Pub. Date: Mar. 3, 2022

(65) Prior Publication Data

US 2023/0304174 A1 Sep. 28, 2023

(30) Foreign Application Priority Data

Aug. 28, 2020 (JP) ..... 2020-144168

(51) Int. Cl.
*C25B 11/093* (2021.01)
*C25B 1/04* (2021.01)
*C25B 11/052* (2021.01)

(52) U.S. Cl.
CPC ..... *C25B 11/093* (2021.01); *C25B 1/04* (2013.01); *C25B 11/052* (2021.01)

(58) Field of Classification Search
None
See application file for complete search history.

(56) References Cited

U.S. PATENT DOCUMENTS

2016/0237578 A1 8/2016 Ichikawa et al.
2019/0078220 A1 3/2019 Kato et al.
2019/0203366 A1* 7/2019 Magalhaes Mendes ..... C25B 11/031
2020/0407860 A1 12/2020 Mitsushima et al.

FOREIGN PATENT DOCUMENTS

JP 2015086420 A 5/2015
JP 2017190476 A 10/2017
WO 2019172160 A1 9/2019

OTHER PUBLICATIONS

English translation WO 2019172160 (Year: 2019).*
Search Report for International Application No. PCT/JP2021/014877 mailed Jun. 29, 2021 (English translation included).
Extended European Search Report for European Application No. 21860849.5, dated Mar. 19, 2025, pp. 1-9.

* cited by examiner

*Primary Examiner* — Stefanie S Wittenberg
(74) *Attorney, Agent, or Firm* — EVENTIDE LAW LLC

(57) ABSTRACT

Provided is an anode for alkaline water electrolysis comprising a conductive substrate and a coating formed on a surface of the conductive substrate, wherein the coating comprises 1) a lithium-containing nickel oxide,
2) an iridium oxide, and
3) at least one of a strontium oxide, a lanthanum oxide, and a calcium oxide.

6 Claims, 1 Drawing Sheet

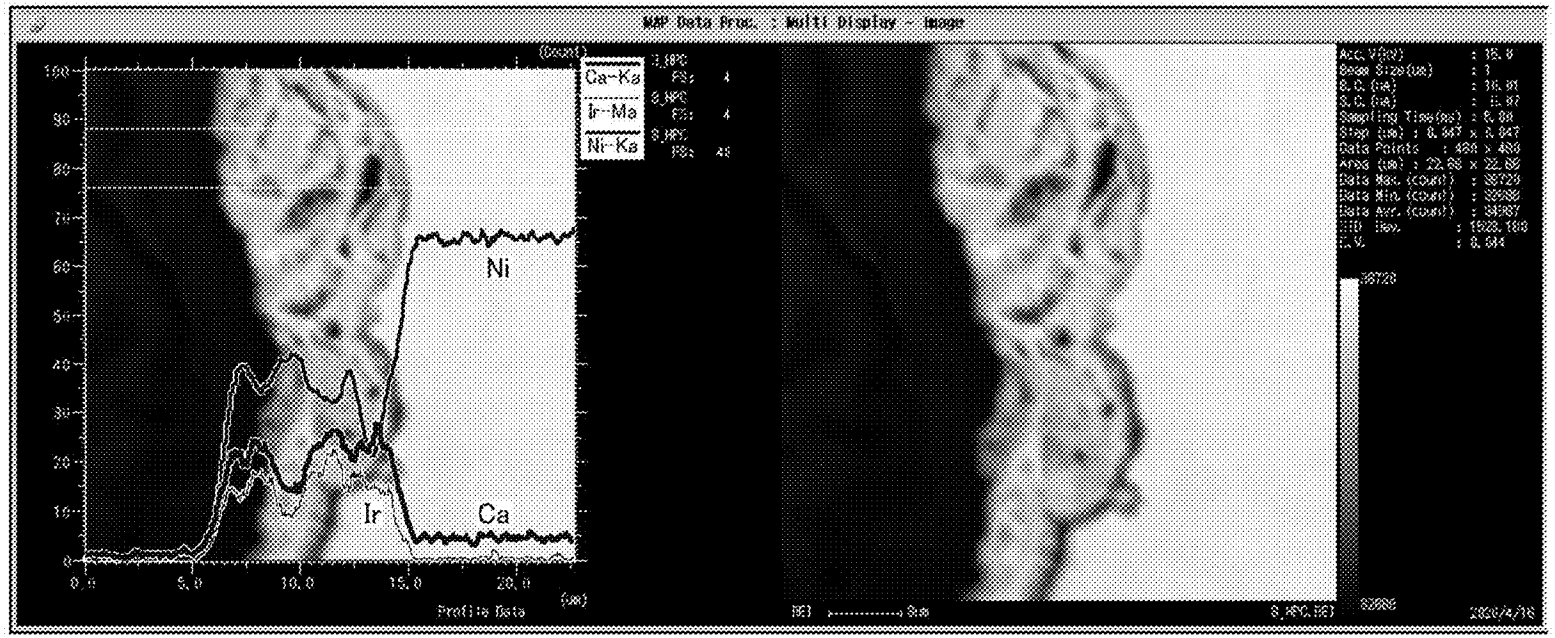
Ni
Ca
Ir
Ca-Ka
Ir-Ma
Ni-Ka

ANODE FOR ALKALINE WATER ELECTROLYSIS

TECHNICAL FIELD

The present invention relates to an anode for alkaline water electrolysis and a manufacturing method therefor.

BACKGROUND ART

Hydrogen is suited to storage and transport and is a secondary energy source with a small environmental burden. Therefore, hydrogen energy systems that use hydrogen as an energy carrier are attracting attention. At present, hydrogen is largely manufactured by steam reforming of fossil fuels and the like. From the viewpoints of the issues of global warming and fossil fuel depletion, the importance of alkaline water electrolysis using renewable energy such as solar batteries, wind power generation, and hydroelectric power generation is increasing.

Low overvoltage (oxygen overvoltage) and a long lifespan are demanded of anodes for alkaline water electrolysis using renewable energy.

Patent Document 1 addresses providing an anode for alkaline water electrolysis which can produce hydrogen by water electrolysis that uses power having high fluctuations in output such as renewable energy and which has high resistance to output fluctuations and describes an anode for alkaline water electrolysis which uses a catalytic layer formed from a lithium-containing nickel oxide. However, because the firing temperature therefor is the extremely high temperature of 900° C. to 1000° C., the anode described in Patent Document 1 is not practical.

Patent Document 2 addresses providing an anode for alkaline water electrolysis which has a low cell voltage while maintaining corrosion resistance and a manufacturing method for the same and describes an anode for alkaline water electrolysis wherein a catalyst component that constitutes an electrode catalyst layer comprises: a first catalyst component having a nickel-cobalt spinel oxide or a lanthanide-nickel-cobalt perovskite oxide; and a second catalyst component having at least one of an iridium oxide and a ruthenium oxide.

CITATION LIST

Patent Document 1: JP 2015-86420 A
Patent Document 2: JP 2017-190476 A

SUMMARY OF INVENTION

The present invention addresses providing an anode for alkaline water electrolysis with low overvoltage and a long lifespan, and a manufacturing method for the same.

As a result of conducting varied research, the present inventors obtained the knowledge that by forming a coating which comprises a lithium-containing nickel oxide, an iridium oxide, and at least one of a strontium oxide, a lanthanum oxide, and a calcium oxide on a conductive substrate, overvoltage in alkaline water electrolysis is reduced and furthermore, catalytic activity of the electrode is maintained for a long period, that is, the lifespan can be prolonged, thereby completing the present invention.

That is, the present invention is: an anode for alkaline water electrolysis comprising a conductive substrate and a coating formed on a surface of the conductive substrate, wherein the coating comprises 1) a lithium-containing nickel oxide, 2) an iridium oxide, and 3) at least one of a strontium oxide, a lanthanum oxide, and a calcium oxide.

According to one aspect of the present invention, provided is the abovementioned anode for alkaline water electrolysis, wherein the coating comprises at least one of a strontium oxide and a lanthanum oxide and from 5 to 25 mol % elemental lithium, from 15 to 35 mol % elemental nickel, from 1 to 20 mol % elemental iridium, and from 40 to 60 mol % of at least one of elemental strontium and elemental lanthanum are present in the coating.

According to one aspect of the present invention, provided is the abovementioned anode for alkaline water electrolysis, wherein from 10 to 20 mol % elemental lithium, from 20 to 30 mol % elemental nickel, from 5 to 15 mol % elemental iridium, and from 45 to 55 mol % of at least one of elemental strontium and elemental lanthanum are present in the coating.

According to one aspect of the present invention, provided is the abovementioned anode for alkaline water electrolysis, wherein the coating comprises a calcium oxide and from 10 to 35 mol % elemental lithium, from 25 to 45 mol % elemental nickel, from 1 to 20 mol % elemental iridium, and from 20 to 40 mol % elemental calcium are present in the coating.

According to one aspect of the present invention, provided is the abovementioned anode for alkaline water electrolysis, wherein from 15 to 30 mol % elemental lithium, from 30 to 40 mol % elemental nickel, from 5 to 15 mol % elemental iridium, and from 25 to 35 mol % elemental calcium are present in the coating.

Furthermore, according to one aspect of the present invention, provided is a method for manufacturing an anode for alkaline water electrolysis, comprising: 1) a step for applying a solution comprising lithium ions, nickel ions, iridium ions, and at least one of strontium ions, lanthanum ions, and calcium ions to a surface of a conductive substrate; and 2) a step for heat-treating the conductive substrate to which the solution has been applied at a temperature of 400° C. to 600° C. in an atmosphere comprising oxygen.

Effects of Invention

According to the present invention, an anode for alkaline water electrolysis with low overvoltage and a long lifespan can be provided.

BRIEF DESCRIPTION OF DRAWINGS

FIG. 1 is an element mapping image of the anode surface of Example 4 by an electron probe microanalyzer (EPMA).

DESCRIPTION OF EMBODIMENTS

One embodiment of the present invention shall be explained in detail below. The present invention is not limited by the following embodiment and can be carried out with the addition of appropriate modifications so long as the effects of the present invention are not hindered. In the following explanation, "A to B" means "A or greater and B or less".

The anode for alkaline water electrolysis according to the present embodiment comprises a conductive substrate and a coating formed on a surface of the conductive substrate, wherein the coating comprises 1) a lithium-containing nickel oxide, 2) an iridium oxide, and 3) at least one of a strontium oxide, a lanthanum oxide, and a calcium oxide.

Due to the coating comprising the components 1) to 3) above, overvoltage as an anode for alkaline water electrolysis is reduced and catalytic activity of the electrode in use as an anode for alkaline water electrolysis is maintained for a long period. The reason that such distinct properties are expressed is thought to be interaction between the components 1) to 3) above, such as electron conductivity of the nickel oxide film improving due to the addition of elemental lithium to the nickel oxide and stabilization of the lithium-containing nickel oxide and iridium oxide by at least one of the strontium oxide, the lanthanum oxide, and the calcium oxide. Further, the stabilization effect discussed above is thought to occur for the strontium oxide, lanthanum oxide, and the calcium oxide as well.

<Conductive Substrate>

The conductive substrate may be a material having conductivity and constant chemical stability against alkalis, for example, stainless steel, nickel, a nickel-based alloy, iron, a nickel-plated iron material, or the like. It is preferable that at least the surface of the conductive substrate be nickel or a nickel-based alloy. The size and thickness of the conductive substrate can be selected without limitation in accordance with the requirements of the alkaline water electrolysis device. The thickness of the conductive substrate is preferably 0.05-5 mm.

The conductive substrate preferably is in a shape having openings for the removal of generated oxygen bubbles, for example, a shape such as a punched plate or an expanded mesh is preferably used. It is preferred that the porosity thereof is 10-95%.

<Coating>

In the anode for alkaline water electrolysis according to the present embodiment, the coating comprises at least one of a strontium oxide and a lanthanum oxide and preferably 5 to 25 mol % and more preferably 10 to 20 mol % elemental lithium, preferably 15 to 35 mol % and more preferably 20 to 30 mol % elemental nickel, preferably 1 to 20 mol % and more preferably 5 to 15 mol % elemental iridium, and preferably 40 to 60 mol % and more preferably 45 to 55 mol % of at least one of elemental strontium and elemental lanthanum are present in the coating.

In the anode for alkaline water electrolysis according to the present embodiment, the coating comprises a calcium oxide and preferably 10 to 35 mol % and more preferably 15 to 30 mol % elemental lithium, preferably 25 to 45 mol % and more preferably 30 to 40 mol % elemental nickel, preferably 1 to 20 mol % and more preferably 5 to 15 mol % elemental iridium, and preferably 20 to 40 mol % and more preferably 25 to 35 mol % elemental calcium, are present in the coating.

Converted into constituent metals, the amount of the lithium-containing nickel oxide, iridium oxide, strontium oxide, lanthanum oxide, and calcium oxide in the coating is, in total, preferably 0.2 $g/m^2$ or greater, more preferably 1 $g/m^2$, still more preferably 2.5 $g/m^2$ or greater, and especially preferably 5 $g/m^2$ or greater.

The method for manufacturing an anode for alkaline water electrolysis according to the present embodiment comprises: 1) a step for applying a solution comprising lithium ions, nickel ions, iridium ions, and at least one of strontium ions, lanthanum ions, and calcium ions to a surface of a conductive substrate; and 2) a step for heat-treating the conductive substrate to which the solution has been applied at a temperature of 400° C. to 600° C. in an atmosphere comprising oxygen.

To increase the adhesion of the coating, it is preferable that a surface-roughening treatment be performed on the conductive substrate before the step for applying the solution. As the surface-roughening treatment, there are blast treatments, etching treatments using a substrate-solubilizing acid or alkali, plasma spray treatments, and the like. Furthermore, performing a chemical etching treatment to remove contaminants on the conductive substrate surface is preferable.

The method to apply the solution to the surface of the conductive substrate is not particularly limited and conventionally known methods such as spray coating can be used.

By heat-treating the conductive substrate to which the solution has been applied, desired oxides can be obtained as the coating components and the coating strength on the conductive substrate becomes enhanced. The heat treatment temperature is 400° to 600° C., preferably 450° C. to 550° C., and more preferably 475° to 525° C. That is, the method for manufacturing an anode for alkaline water electrolysis according to the present embodiment can be performed under practical temperature conditions at which mass production is possible and thus has high productivity.

The time for the heat treatment is preferably 5-60 minutes, more preferably 5-20 minutes, and still more preferably 5-15 minutes.

As a method aside from applying the solution to the surface of the conductive substrate and then heat-treating, it is possible to use a film-forming technique such as CVD or PVD.

EXAMPLES

Examples of the present invention shall be shown below. The details of the present invention shall not be construed to be limited by these examples.

As follows, anodes according to Examples 1-4 and Comparative Examples 1-18 were manufactured.

Preparation of Conductive Substrate

A nickel mesh (100 mm×100 mm, thickness: 0.8 mm) was prepared and the surface thereof blasted with alumina powder (central particle size: 250-212 μm). Next, the nickel mesh was etched for three minutes with a boiling 20 wt % aqueous hydrochloric acid to prepare the nickel mesh as the conductive substrate.

Preparation of Coating Liquid

As precursors for the components in the coating, nickel acetate, lithium acetate, iridium hydroxyacetochloride complex, ferric nitrate, nickel nitrate, manganese nitrate, lanthanum nitrate, strontium nitrate, and calcium nitrate were mixed at desired ratios and coating liquids comprising the components in the contained amounts shown in Table 1 were prepared.

The coating liquid described in Example 1 in Patent Document 2 (JP 2017-190476 A) was used for Comparative Example 2.

Anode Manufacture

Each coating liquid was coated on the nickel mesh such that the amount of metal becomes 6.25 $g/m^2$. The substrates were then dried for 10 minutes in a drier at a temperature of 60° C. and further heat-treated for 10 minutes in an electric furnace at a temperature of 500° C. The substrates were then set aside until they became room temperature and the anodes were manufactured.

X-ray diffraction analysis with an X-ray fluorescence analyzer and element mapping with an electron probe microanalyzer (EPMA) were performed on the manufactured anodes and it was confirmed that the intended oxides were formed in the intended coatings. As one example thereof, FIG. 1 shows an element mapping image of the anode surface of Example 4 by an electron probe microanalyzer (EPMA). Nickel, iridium, and calcium derived from the nickel oxide, iridium oxide, and calcium oxide are present in the coatings (note that although lithium does not appear in the EPMA element mapping image, it is clear that it is present).

TABLE 1

| | COATING TYPE | COMPONENTS (g/l) | | | | | | | |
|---|---|---|---|---|---|---|---|---|---|
| | | Fe | Mn | Ni | La | Sr | Li | Ir | Ca |
| COMPARATIVE EXAMPLE 1 | NO COATING | | | | | | | | |
| COMPARATIVE EXAMPLE 2 | $NiCo_2O_4$—$IrO_2$ (PATENT DOCUMENT 2) | EXAMPLE 1 IN PATENT DOCUMENT 2 | | | | | | | |
| COMPARATIVE EXAMPLE 3 | Fe ONLY | 33.5 | | | | | | | |
| COMPARATIVE EXAMPLE 4 | Fe—Li | 33.5 | | | | | 1.3 | | |
| COMPARATIVE EXAMPLE 5 | Fe—Ni | 33.5 | | 17.6 | | | | | |
| COMPARATIVE EXAMPLE 6 | Fe—Li—Ir | 33.5 | | | | | 1.3 | 20.1 | |
| COMPARATIVE EXAMPLE 7 | Fe—Ni—Li—Ir | 33.5 | | 17.6 | | | 1.3 | 20.1 | |
| COMPARATIVE EXAMPLE 8 | Mn ONLY | | 33.5 | | | | | | |
| COMPARATIVE EXAMPLE 9 | Mn—Li (Mn:Li = 1:3 mol) | | 33.5 | | | | 1.4 | | |
| COMPARATIVE EXAMPLE 10 | Mn—Li (Mn:Li = 1:2 mol) | | 33.5 | | | | 2.1 | | |
| COMPARATIVE EXAMPLE 11 | Mn—Li (Mn:Li = 1:1 mol) | | 33.5 | | | | 4.2 | | |
| COMPARATIVE EXAMPLE 12 | Mn—Li—Ni | | 16.7 | 17.9 | | | 1.4 | | |
| COMPARATIVE EXAMPLE 13 | La ONLY | | | | 33 | | | | |
| COMPARATIVE EXAMPLE 14 | La—Li | | | | 33 | | 0.5 | | |
| COMPARATIVE EXAMPLE 15 | La—Li—Ir | | | | 33 | | 0.5 | 7.9 | |
| EXAMPLE 1 | La—Ni—Li—Ir | | | 7.07 | 33 | | 0.5 | 7.9 | |
| COMPARATIVE EXAMPLE 16 | Sr ONLY | | | | | 33 | | | |
| COMPARATIVE EXAMPLE 17 | Sr—Li | | | | | 33 | 0.9 | | |
| COMPARATIVE EXAMPLE 18 | Sr—Li—Ir | | | | | | 0.9 | 12.5 | |
| EXAMPLE 2 | Sr—Ni—Li—Ir | | | 11.2 | | 33 | 0.9 | 12.5 | |
| EXAMPLE 3 | Sr—Ni—Li—Ir | | | 11.2 | | 33 | 0.9 | 20.1 | |
| EXAMPLE 4 | Ca—Ni—Li—Ir | | | 18.1 | | | 1.4 | 20.1 | 10.5 |

Overvoltage Measurement

The overvoltage of each of the anodes of Examples 1-4 and Comparative Examples 1-18 was measured at 80° C. and a current density of 10 kA/$m^2$ in a 25 wt % aqueous potassium hydroxide solution.

Further, persistence of iridium before and after the overvoltage measurement was calculated from the fluorescent X-ray intensity ratio of iridium using an X-ray fluorescence analyzer.

The results are shown in Table 2. In "Evaluation" in Table 2, ○ is for cases where the overvoltage value is low as compared with Comparative Example 2 and the persistence of iridium after the overvoltage measurement is 99% or greater and x is for cases other than this.

TABLE 2

| | OVERVOLTAGE 10 kA/$m^2$ (mV) | Ir PERSISTENCE (%) | EVALUATION |
|---|---|---|---|
| COMPARATIVE EXAMPLE 1 | 342 | — | |
| COMPARATIVE EXAMPLE 2 | 255 | 88 | REFERENCE |
| COMPARATIVE EXAMPLE 3 | 389 | — | x |
| COMPARATIVE EXAMPLE 4 | 509 | — | x |

TABLE 2-continued

| | OVERVOLTAGE 10 kA/$m^2$ (mV) | Ir PERSISTENCE (%) | EVALUATION |
|---|---|---|---|
| COMPARATIVE EXAMPLE 5 | 497 | — | x |
| COMPARATIVE EXAMPLE 6 | 511 | — | x |
| COMPARATIVE EXAMPLE 7 | 357 | — | x |
| COMPARATIVE EXAMPLE 8 | 301 | — | x |
| COMPARATIVE EXAMPLE 9 | 291 | — | x |
| COMPARATIVE EXAMPLE 10 | 307 | — | x |
| COMPARATIVE EXAMPLE 11 | 204 | 93 | x |
| COMPARATIVE EXAMPLE 12 | 228 | 97 | x |
| COMPARATIVE EXAMPLE 13 | 480 | — | x |
| COMPARATIVE EXAMPLE 14 | 465 | — | x |
| COMPARATIVE EXAMPLE 15 | 261 | 100 | x |
| EXAMPLE 1 | 241 | 100 | ○ |
| COMPARATIVE EXAMPLE 16 | 360 | — | x |

TABLE 2-continued

| | OVERVOLTAGE 10 kA/m$^2$ (mV) | Ir PERSISTENCE (%) | EVALUATION |
|---|---|---|---|
| COMPARATIVE EXAMPLE 17 | 348 | — | x |
| COMPARATIVE EXAMPLE 18 | 264 | 100 | x |
| EXAMPLE 2 | 221 | 99 | ○ |
| EXAMPLE 3 | 221 | 99 | ○ |
| EXAMPLE 4 | 215 | 99 | ○ |

In the anodes of Examples 1-4 of the present invention, overvoltage was surprisingly even lower than that for the anode of Comparative Example 2, in which the overvoltage of a nickel mesh which had not been coated greatly improved.

Furthermore, the persistence of iridium after the overvoltage measurement was 99% or greater for the anodes of Examples 1-4 of the present invention. That is, it is understood that overvoltage is extremely low and consumption of the catalyst metal is low, and the catalyst activity of the electrode is maintained for a long period in the anode of the present invention.

Accelerated Life Testing

Accelerated life testing was performed on the anodes of Examples 2, 3, and 4. The test was performed with the following conditions: the anodes were the anodes of Examples 2, 3, and 4, the cathodes were nickel mesh, the distance between the anodes and cathodes was 10 mm, the electrolysis cell was a single-chamber cell, the electrolytic solution was 30 wt % aqueous potassium hydroxide solution, the temperature was 88° C., and the current density was 30 kA/m$^2$. The results were that the cell voltage was stable for as long as 1500 hours for the anodes of Examples 2, 3, and 4.

As above, the anode of the present invention has the extremely superior properties as an anode for alkaline water electrolysis not only of overvoltage being low, but catalytic activity of the electrode being maintained for a long period, that is, the lifespan being prolonged.

The invention claimed is:

1. An anode for alkaline water electrolysis comprising:
a conductive substrate and
a coating formed on a surface of the conductive substrate, wherein the coating comprises in a single layer:
1) a lithium-containing nickel oxide,
2) an iridium oxide, and
3) at least one of a strontium oxide, a lanthanum oxide, and a calcium oxide.

2. The anode for alkaline water electrolysis according to claim 1,
wherein the coating comprises at least one of a strontium oxide and a lanthanum oxide and
from 5 to 25 mol % elemental lithium,
from 15 to 35 mol % elemental nickel,
from 1 to 20 mol % elemental iridium, and
from 40 to 60 mol % of at least one of elemental strontium and elemental lanthanum are present in the coating.

3. The anode for alkaline water electrolysis according to claim 2,
wherein from 10 to 20 mol % elemental lithium,
from 20 to 30 mol % elemental nickel,
from 5 to 15 mol % elemental iridium, and
from 45 to 55 mol % of at least one of elemental strontium and elemental lanthanum are present in the coating.

4. The anode for alkaline water electrolysis according to claim 1,
wherein the coating comprises a calcium oxide and
from 10 to 35 mol % elemental lithium,
from 25 to 45 mol % elemental nickel,
from 1 to 20 mol % elemental iridium, and
from 20 to 40 mol % elemental calcium
are present in the coating.

5. The anode for alkaline water electrolysis according to claim 4,
wherein from 15 to 30 mol % elemental lithium,
from 30 to 40 mol % elemental nickel,
from 5 to 15 mol % elemental iridium, and
from 25 to 35 mol % elemental calcium
are present in the coating.

6. A method for manufacturing the anode for alkaline water electrolysis according to claim 1, comprising:
1) a step for applying a solution comprising lithium ions, nickel ions, iridium ions, and at least one of strontium ions, lanthanum ions, and calcium ions to a surface of a conductive substrate; and
2) a step for heat-treating the conductive substrate to which the solution has been applied at a temperature of 400° C. to 600° C. in an atmosphere comprising oxygen, thereby obtaining the anode for alkaline water electrolysis.

* * * * *